United States Patent [19]

Detweiler

[11] Patent Number: 4,463,716

[45] Date of Patent: Aug. 7, 1984

[54] THROTTLE POSITIONING DEVICE

[75] Inventor: Charles A. Detweiler, Durand, Mich.

[73] Assignee: Tom McGuane Industries, Inc., Madison Heights, Mich.

[21] Appl. No.: 419,740

[22] Filed: Sep. 20, 1982

[51] Int. Cl.[3] ..... F02B 77/00

[52] U.S. Cl. ..... 123/198 DB; 123/376; 123/DIG. 11

[58] Field of Search ..... 123/339, 384, 198 DB, 123/198 D, DIG. 11, 376; 261/65, DIG. 18, DIG. 19

[56] References Cited

U.S. PATENT DOCUMENTS

| | | | |
|---|---|---|---|
| 3,730,153 | 5/1973 | Harrison et al. | 123/339 |
| 3,752,141 | 8/1973 | Charron et al. | 261/65 |
| 3,760,785 | 9/1973 | Harrison et al. | 123/198 DB |
| 3,847,131 | 11/1974 | Hisatomi | 123/198 DB |
| 4,086,900 | 5/1978 | Marsh | 123/DIG. 11 |

*Primary Examiner*—William A. Cuchlinski, Jr.
*Attorney, Agent, or Firm*—Barnes, Kisselle, Raisch, Choate, Whittemore & Hulbert

[57] ABSTRACT

A throttle positioning device comprising a housing and a diaphragm in the housing dividing the housing into first and second chambers. The housing has an opening extending to the first chamber for connection to vacuum. A solenoid is associated with the housing and has a plunger acted upon by energization of the solenoid. The plunger is yieldingly urged by a light spring against a solenoid stop connected to the diaphragm such that the stop is movable with the diaphragm. A stem is adapted to be moved by the plunger and extends through the movable stop to the exterior of said housing to define a movable throttle stop. The throttle lever, attached to the throttle shaft of the carburetor yieldingly urges the throttle stop to a retracted position against the lighter spring force of the solenoid plunger. The diaphragm is yieldingly urged to move the movable solenoid stop toward the solenoid. When the solenoid is energized and vacuum is not being supplied to the first chamber, the stem is in a first position, and when said solenoid is energized and vacuum is supplied to the first chamber, the stem is in a second position. When the engine is stopped and the solenoid de-energized, the throttle element urges the stop to a third position against the action of the lighter spring to provide an anti-dieseling function. In another form, the throttle positioning device includes a wall in the housing cooperating with the first diaphragm to form a second chamber, and a second diaphragm cooperates with the wall to define third and fourth chambers. The housing has an opening for connection to vacuum to the third chamber. The first and second diaphragms are movable independently of one another, such that when the solenoid is energized and vacuum is applied to the second opening, the second diaphragm moves the first diaphragm to move the magnetic stop permitting the stem to be moved by the solenoid plunger to a fourth position.

14 Claims, 7 Drawing Figures

27
27a
26

41
40
37
38
10
21
12
25
17
18
16
19
23
39
14
13
11
15
20
24
27a
24a
26
27
31
29
33
30
32
34
35
36

THROTTLE POSITIONING DEVICE

This invention relates to throttle positioning devices to control the idle speed of an internal combustion engine.

BACKGROUND AND SUMMARY OF THE INVENTION

In order to control the idle speed of an internal combustion engine, it has been common to utilize various types of devices which function to form a stop for the throttle. Such devices have been commonly known as throttle kickers and are shown, for example, in U.S. Pat. Nos. 3,730,153, 3,760,785 and 4,056,082. The devices have been commonly electrically energized solenoids or vacuum actuated diaphragm devices or combinations of the two. In such devices combining a solenoid and a vacuum actuated device, the devices may not have been capable of an anti-dieseling function because when the solenoid is de-energized, vacuum continues to maintain the stem of the device so that the stem cannot return to its original position unless provision is made for relieving the vacuum quickly.

Another problem of the combined type of throttle positioning device has been that the solenoid must have sufficient force to overcome the hysteresis of the vacuum device and the friction of the seals.

Among the objectives of the present invention are to provide a throttle positioning device which is capable of positioning the throttle stop that, in turn, controls the throttle position and which utilized a solenoid and a vacuum device wherein the stem that functions as a throttle stop will return to its most retracted position when the solenoid is deenergized; which will preferably provide at least four positions of the stem; wherein the solenoid will function to move the stem without independently moving the vacuum actuated device; and wherein the position of the stem can be adjusted to set the normal idle RPM.

In accordance with the invention, the throttle positioning device comprises a housing, a diaphragm in the housing dividing the housing into first and second chambers. The housing has an opening extending to the first chamber for connection to vacuum. A solenoid is associated with the housing and has a plunger slideable upon energization of the solenoid. The plunger is yieldingly urged by a light spring against a solenoid stop connected to the diaphragm such that the stop is movable with the diaphragm. A stem is adapted to be connected to the plunger and extends through the movable stop to the exterior of the housing to define a movable throttle stop. The throttle lever, attached to the throttle shaft of the carburetor, yieldingly urges the throttle stop to a retracted position against the lighter spring force of the solenoid plunger. The diaphragm is yieldingly urged to move the movable solenoid stop toward the solenoid. When the solenoid is energized and vacuum is not being supplied to the first chamber, the stem is in a first position, and when said solenoid is energized and vacuum is supplied to the first chamber, said stem is in a second position. In another form, the throttle positioning device includes a wall in the housing cooperating with the first diaphragm to form the second chamber, and a second diaphragm cooperating with the wall to define third and fourth chambers. The housing has an opening for connection to vacuum. The first and second diaphragms are movable independently of one another, such that when the solenoid is energized and vacuum is applied to the second opening, the second diaphragm moves the first diaphragm to move the magnetic stop so that the stem is moved by the solenoid plunger to a fourth position.

DESCRIPTION

Figures 1, 2A:
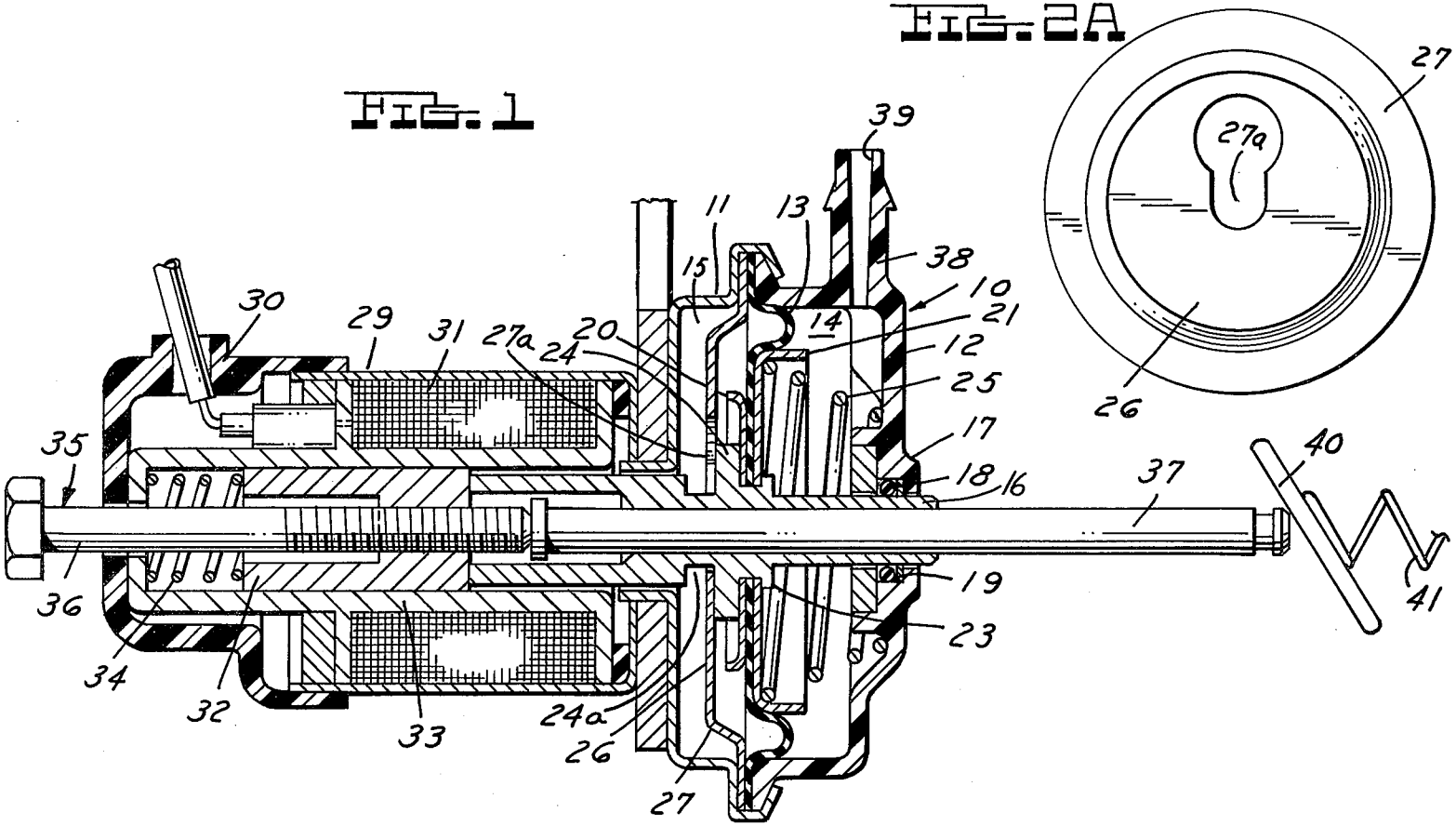
FIG. 1 is a part sectional longitudinal view of a throttle positioning device embodying the invention.
FIG. 2A is a plan view of a portion of the device shown in FIG. 1.

Referring to FIG. 1, the throttle positioning device 10 embodying the invention comprises a housing made of two parts including a first metal member 11, a second plastic member 12, the first member 11 being crimped over a portion of the plastic member 12 to hold a diaphragm 13 in position dividing the housing into a first chamber 14 and a second chamber 15.

The diaphragm 13 is connected at its inner periphery to a magnetic stop member 16 that is movable axially of the housing, one end of the device extending through a hub 17 in member 12 and being sealingly engaged by an O-ring 18 positioned in a groove 19 in the hub 17. More specifically, the inner periphery of diaphragm 13 is clamped between washers 20, 21 that are mounted on member 16, a flange 23 being deformed to hold the washers 21, 22 and diaphragm 13 clamped against a radial wall 24. A spring 25 is interposed between housing member 12 and washer 22 to urge the diaphragm to the left and move wall 24 against a stop 26 defined by a metal spacer 27 clamped between the peripheries of housing member 11 and diaphragm 13. Plate 27 engages a groove **24*a* in the wall of the magnetic stop 16. To facilitate assembly, plate 27 is formed with a keyhole 27*a* (FIG. 2A) so that the magnetic stop 16 can be telescoped through the enlarged portion of keyhole 27*a* and then moved radially to engage the groove 24*a*. Plate 27** functions to reduce dimensional stack up which affects the travel of the magnetic stop and permits more accurate control of the function.

The throttle positioning device further includes a solenoid 28 including a metal solenoid housing 29 and a plastic or rubber end cap 30 supporting a solenoid winding 31 and a plunger 32 slidingly received within a support member 33 for the winding 31. The magnetic stop member 16 has its other end extending into the solenoid support member to define a stop for the plunger 32. A light spring 34 urges the solenoid plunger 32 against the stop member 16.

A throttle positioning stem 35 is adjustably threaded in the plunger 32 and is herein shown as including a first part 36 threaded in the plunger 31 and an axially movable second part 37 slideably extending through magnetic stop 16, although a single stem can be used.

An integral fitment 38 in housing part 12 forms an opening 39 for connection to a source of vacuum to the first chamber. A throttle element 40 connected to the carburetor linkage is yieldingly urged by spring 41 to oppose movement of the stem 35. Spring 41 overcomes the force of spring 34 to hold the stop member 16 and solenoid plunger 32 in position.

When the solenoid is energized, the stem 35 is moved independently of the diaphragm 13 to a first positon. When the solenoid is energized and vacuum is applied to the first chamber 14, the position of the stop member 16 is moved by diaphragm 13 permitting the solenoid to move the plunger 31 further so that the stem 35 is moved to a second position. The stem movement to each of the first and second positions is against spring 41 that urges the throttle element 40, when the throttle is released toward an idle position. When the solenoid is de-energized, the spring 41 acting on the throttle element will return the solenoid to another third position independently of whether or not vacuum is being applied to the first chamber 14 to provide an anti-dieseling function.

Figures 2, 3, 4, 5, 6:
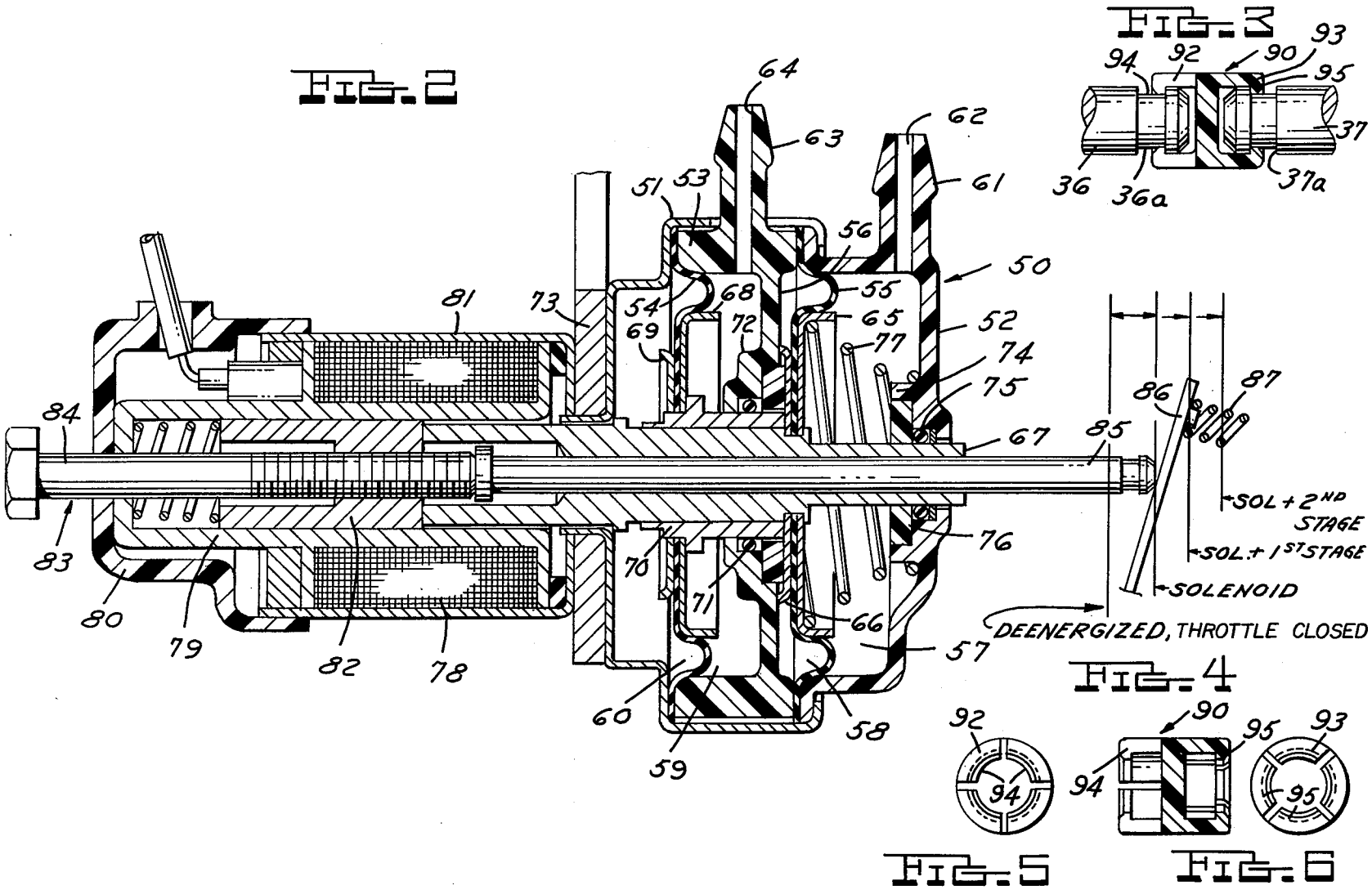
FIG. 2 is a longitudinal sectional view of a modified form of throttle positioning device.
FIG. 3 is a fragmentary part sectional view of a modified connection between the parts of the stem of the devices shown in FIGS. 1 and 2.
FIG. 4 is a part sectional side view of the connector shown in FIG. 3.
FIG. 5 is a left end view of the connector shown in FIG. 4.
FIG. 6 is a right end view of the connector shown in FIG. 4.

The throttle positioning device shown in FIG. 2 provides four positions. The throttle positioning device comprises a housing 50 comprising a metal part 51 having its periphery clamped over a plastic part 52 to hold and clamp together a spacer ring 53 and the periphery of diaphragms 54, 55. Spacer ring 53 has a wall 56 which together with diaphragms 54, 55 divides the housing into a first chamber 57, a second chamber 58, a third chamber 59 and a fourth chamber 60. A fitting 61 in housing part 52 defines an opening 62 for connection to vacuum to the chamber 59 and a fitting 63 in spacer ring 53 defines an opening 64 from the third chamber 59 to a second cource of vacuum. Diaphragm 55 is clamped between washers 65, 66, are fixed to magnetic stop member 67. Diaphragm 54 is clamped between washers 68, 69 on a guide member 70 slideable on magnetic stop member 67. The guide member 70 sealingly engages on O-ring 71 in a hub 72 on wall 56 of the spacer ring 53.

The magnetic stop member 67 extends axially in one direction through an intermediate wall 73 of the housing part 51 and in the other direction through a hub 74 in the housing part 52 that supports an O-ring 75 held in position by a staked in washer 76 to define a seal between the hub 74 and the stop 67. A spring 77 is interposed between the diaphragm 55 and the housing part 51 to yieldingly urge the diaphragm 55 and the magnetic stop 67 to the left as viewed in FIG. 2.

The housing further includes a solenoid winding 78 supported by a member 79 and end cap 80 within an extension 81 of the housing. The solenoid includes a plunger 82 slideable within the solenoid member 79 and a stem 83 is threaded into the plunger 82 to adjustably position the stem longitudinally thereof. The stem is formed in two parts, as shown, the first part 84 being threaded through the solenoid 82 and the second part 85 slidingly extending through the magnetic stop 67 to the exterior of the housing at the other end. The free end is adapted to be engaged by a spring 87 and connected to the linkage of the throttle so that the free end defines an adjustable throttle stop when the throttle is released and the spring extends the throttle toward its idle position.

As shown by the diagrammatic positions of FIG. 2, when the solenoid is energized, the stem is held against the end of the movable magnetic stop 67 in a first position independently of the diaphragms 54, 55, the diaphragms remaining in the same position.

When the solenoid is energized and vacuum is applied through opening 64 to the chamber 59, the diaphragm 54 moves the magnetic stop 67 and compresses spring 35 permitting the solenoid to move the stem to a second position. When vacuum is applied to the opening 62, the diaphragm 55 is moved further to the right moving movable magnetic stop 67 further so that the magnetic stop 67 is moved to permit the stem to move to a third position.

When the solenoid is de-energized, the stem can be moved by spring loaded throttle element 86 independently of the magnetic stop to another fourth position independently of whether or not vacuum is applied through the opening 62, 64 to provide an anti-dieseling function.

A control plate like control plate 27 can be added to the form shown in FIG. 2 in the same manner as in the form shown in FIG. 1.

In either of the forms of the invention, the stem 35, 83 can be made in one piece. However, it may be difficult to maintain the concentricity required to prevent binding between the stem, the solenoid plunger and the magnetic stop. The two piece construction allows the parts to align without interference.

In order to prevent noise and possible damage that may occur if the two parts moved relatively back and forth axially, a swivel connector 90 is provided between the parts 36, 38 (or 84, 85) of the stem (FIGS. 3–6). The connector 90 preferably comprises a part which is made of plastic such as nylon which has a central wall 91 and axially oppositely extending sets of fingers 92, 93 with radially inwardly extending tabs 94, 95 that snap into and engage grooves **36*a*, 37*a***, respectively. This allows for misalignment between the two parts of the stem but limits the relative axial movement between them.

I claim:

1. A throttle positioning device comprising a housing, a diaphragm in said housing dividing the housing into first and second chambers, said housing having an opening extending to said first chamber for connection to vacuum, a solenoid associated with said housing, said solenoid having a plunger slideable upon energization of said solenoid, a solenoid stop, means for connecting said solenoid stop to said diaphragm such that said stop is movable with said diaphragm, a stem operatively connected to said plunger and extending through said movable stop to the exterior of said housing to define a movable throttle stop, a movable throttle element engaging said stem, spring means yielding urging said throttle element in a first direction against said stem, means yieldingly urging said diaphragm in said first direction as the stem is urged toward said plunger into a first position such that the movable solenoid stop is urged toward said solenoid such that when the solenoid is energized and vacuum is not being supplied to said first chamber, said stem is in a first position, and when said solenoid is energized and vacuum is supplied to said first chamber, said stem is moved in the opposite direction from said first direction to a second position and when the solenoid is de-energized, the throttle element can urge the stem in the first direction to a third position independent of the movement of the diaphragm to provide an anti-dieseling function.

2. The throttle positioning device set forth in claim 1 including means providing a seal between said movable solenoid stop and said housing.

3. The throttle position device set forth in claim 1 including a control member in said second chamber operable to limit the axial movement of the solenoid stop when the solenoid is energized.

4. The throttle positioning device set forth in claim 3 wherein said control member comprises a wall within said housing, a groove in said solenoid stop, said wall having a portion thereof projecting in said groove, said groove having an axial dimension greater than the thickness of said portion of said wall such that said solenoid stop has limited axial movement relative to said wall.

5. A throttle positioning device comprising a housing, a diaphragm in said housing dividing the housing into first and second chambers, said housing having an opening extending to said first chamber for connection to vacuum, a solenoid associated with said housing, said solenoid having a plunger slidable upon energization of said solenoid, a solenoid stop, means for connecting said solenoid stop to said diaphragm such that said stop is movable with said diaphragm, a stem operatively connected to said plunger and extending through said movable stop to the exterior of said housing to define a movable throttle stop, a movable throttle element engaging said stem, spring means yieldingly urging said throttle element against said stem, means yieldingly urging said diaphragm into a first position such that the movable solenoid stop is urged toward said solenoid such that when the solenoid is energized and vacuum is not being supplied to said first chamber, said stem is in a first position, and when said solenoid is energized and vacuum is supplied to said first chamber, said stem is in a second position and when the solenoid is de-energized, the throttle element can urge the stem to a third position independent of the movement of the diaphragm to provide an anti-dieseling function, said movable stop and said stem being in sliding relationship to one another.

6. A throttle positioning device comprising a housing, a diaphragm in said housing dividing the housing into first and second chambers, said housing having an opening extending to said first chamber for connection to vacuum, a solenoid associated with said housing, said solenoid having a plunger slidable upon energization of said solenoid, a solenoid stop, means for connecting said solenoid stop to said diaphragm such that said stop is movable with said diaphragm, a stem operatively connected to said plunger and extending through said movable stop to the exterior of said housing to define a movable throttle stop, a movable throttle element engaging said stem, spring means yieldingly urging said throttle element against said stem, means yieldingly urging said diaphragm into a first position such that the movable solenoid stop is urged toward said solenoid such that when the solenoid is energized and vacuum is not being supplied to said first chamber, said stem is in a first position, and when said solenoid is energized and vacuum is supplied to said first chamber, said stem is in a second position and when the solenoid is de-energized, the throttle element can urge the stem to a third position independent of the movement of the diaphragm to provide an anti-dieseling function, said stem comprising two parts, one being fixed to said plunger and the other slidingly received in said movable solenoid stop such that it is movable axially outwardly of the housing by the plunger and axially inwardly by engagement with a throttle element.

7. The throttle positioning device set forth in claim 6 including a connector between said two parts.

8. The throttle positioning device set forth in claim 7 wherein said connector is made of plastic and includes a transversely extending portion adapted to be engaged by said two parts.

9. The throttle positioning device set forth in claim 8 wherein said connector comprises spaced sets of axially extending fingers, each said part having a groove adjacent its end, said fingers having radial portions adapted to engage the grooves.

10. The throttle positioning device set forth in claim 6 wherein said means connecting said second diaphragm to said first diaphragm comprises a guide member slidable on said solenoid stop to which one of said diaphragms is connected, the other said diaphragm being connected to said solenoid stop, said guide member having interengaging means with said solenoid stop such that said guide member has limited movement relative to said solenoid stop and said other diaphragm.

11. A throttle positioning device comprising a housing, a diaphragm in said housing dividing the housing into first and second chambers, said housing having an opening extending to said first chamber for connection to vacuum, a solenoid associated with said housing, said solenoid having a plunger slidable upon energization of said solenoid, a solenoid stop, means for connecting said solenoid stop to said diaphragm such that said stop is movable with said diaphragm, a stem operatively connected to said plunger and extending through said movable stop to the exterior of said housing to define a movable throttle stop, a movable throttle element engaging said stem, spring means yieldingly urging said throttle element against said stem, means yieldingly urging said diaphragm into a first position such that the movable solenoid stop is urged toward said solenoid such that when the solenoid is energized and vacuum is not being supplied to said first chamber, said stem is in a first position, and when said solenoid is energized and vacuum is supplied to said first chamber, said stem is in a second position and when the solenoid is de-energized, the throttle element can urge the stem to a third position independent of the movement of the diaphragm to provide an anti-dieseling function, a wall in said housing cooperating with said first diaphragm to form said second chamber, and a second diaphragm cooperating with said wall to define a third and fourth chamber, said housing having an opening for connection of vacuum to said third chamber, means for connecting said second diaphragm to said first diaphragm for relative axial movement, such that when the solenoid is energized and vacuum is applied to said second opening, the second diaphragm moves the first diaphragm to move the magnetic stop to permit the stem to be moved by the solenoid plunger to a fourth positon.

12. The throttle positioning device set forth in claim 11 including means providing a seal between said movable solenoid stop and said housing.

13. The throttle positioning device set forth in claim 12 wherein said movable solenoid stop and said stem are in sliding relationship to one another.

14. The throttle positioning device set forth in claim 13 wherein said stem comprises two parts, one being fixed to said plunger and the other slidingly received in said movable solenoid stop such that it is movable axially outwardly of the housing by the plunger and axially inwardly by engagement with a throttle element.

* * * * *